United States Patent [19]

Schneiter et al.

[11] Patent Number: 4,504,703

[45] Date of Patent: Mar. 12, 1985

[54] ELECTRO-ACOUSTIC TRANSDUCER

[75] Inventors: Ali Schneiter, Neuchâtel; Jean-Frédéric Flückiger; Anne Curchod, both of Colombier, all of Switzerland

[73] Assignee: Asulab S.A., Bienne, Switzerland

[21] Appl. No.: 641,416

[22] Filed: Aug. 16, 1984

Related U.S. Application Data

[63] Continuation of Ser. No. 381,964, May 25, 1982.

[30] Foreign Application Priority Data

Jun. 1, 1981 [CH] Switzerland ..... 558/81

[51] Int. Cl.[3] ..... H04R 1/22

[52] U.S. Cl. ..... 179/102; 179/115.5 PS; 179/116; 181/163

[58] Field of Search ..... 179/116, 102, 103, 105, 179/111 E, 115.5 ES, 181 R, 180, 139; 181/144, 163; 310/324; 367/163, 174, 175

[56] References Cited

U.S. PATENT DOCUMENTS

| | | | |
|---|---|---|---|
| 1,412,539 | 4/1922 | Murray | 179/102 |
| 1,460,034 | 6/1923 | Murray | 179/102 |
| 1,772,198 | 8/1930 | Anderson | 179/102 |
| 2,634,337 | 4/1953 | Bland | 179/102 |
| 2,903,673 | 9/1959 | Harris | 181/163 |
| 3,306,990 | 2/1967 | Walker | 179/102 |
| 3,538,494 | 11/1968 | Erickson | 367/174 |
| 3,821,492 | 6/1974 | Tamura et al. | 179/116 |
| 3,943,304 | 3/1976 | Piribauer | 179/105 |
| 4,147,899 | 4/1979 | Mori et al. | 179/116 |
| 4,268,725 | 5/1981 | Nakagawa | 179/111 E |

FOREIGN PATENT DOCUMENTS

| | | | |
|---|---|---|---|
| 0067790 | 12/1982 | European Pat. Off. | 179/111 E |
| 53-79495 | 7/1978 | Japan | 179/116 |
| 829608 | 3/1960 | United Kingdom | 179/116 |

*Primary Examiner*—Thomas W. Brown
*Assistant Examiner*—L. C. Schroeder
*Attorney, Agent, or Firm*—Spensley Horn Jubas & Lubitz

[57] ABSTRACT

An electro-acoustic transducer capable of operating as an emitter and as a pick-up for acoustic waves in an ambient medium includes a cover member having an opening for communication with the ambient medium, first and second diaphragms which are spaced from each other within the cover member, the second diaphragm being capable of vibrating under the effect of acoustic waves and being disposed between the first diaphragm and the opening in the cover member, an electromagnet for causing vibrations of the first diaphragm in response to electrical excitation signals when the transducer is operating in the emitter mode, an air cushion contained in a closed chamber separating the two diaphragms or a rigid mechanical connection between the two diaphragms for communicating the vibrations of the first diaphragm to the second diaphragm, and a pair of electrodes disposed on opposite sides of the second diaphragm, which is preferably a sheet of electret, for producing an output signal in response to vibrations of the second diaphragm produced by acoustic waves which are propagated in the ambient medium when the transducer is operating in the pick-up mode.

11 Claims, 2 Drawing Figures

ELECTRO-ACOUSTIC TRANSDUCER

This is a continuation of application Ser. No. 381,964, filed on May 25, 1982.

BACKGROUND OF THE INVENTION

The present invention relates to an electro-acoustic transducer which can be used both as an emitter and as a pick-up for acoustic waves in an ambient medium.

Since the physical phenomena (electromagnetism, electrostatics and piezo-electricity) which are utilized for producing electro-acoustic transducers are reversible, it is in principle possible to use the same piece of equipment for emitting sound waves in response to an electrical signal and conversely for converting acoustic vibrations into electrical current or voltage variations. In practice, however, transducers intended for use as microphones and as loudspeakers which operate on the basis of a given principle are not constructed in the same manner. The dimensions, shape and arrangement of the components forming the device differ in the two cases. For example, in order to be sufficiently responsive to sound waves, the diaphragm of a microphone must be much less rigid than that of a loudspeaker.

Therefore, providing a piece of equipment with the facility to emit and receive sounds requires the joining of both a loudspeaker and a microphone which are separate from each other, each transducer having characteristics selected to adapt it optimally to its respective function, taking into account the inherent properties of the transducer type.

This gives rise to a problem when dealing with portable devices which are to be of minimum size. This is the case in particular with watches which are designed on the one hand to indicate the time or provide other items of information, either in the form of simple single-tone sounds or in a "spoken" form by means of words or groups of words which are stored in a memory, and on the other hand have functions, such as altering the time display, which can be controlled directly by use of the voice. The fact that such watches have to include two independent transducers, in addition to the usual components required to derive and display the time, militates against the efforts which are being made at the present time to reduce the size of such watches.

OBJECT OF THE INVENTION

The object of the present invention is to overcome this disadvantage by providing a small-scale electro-acoustic transducer which is capable of operating selectively in a microphone mode and in a loudspeaker mode, (and which will accordingly be called a mixed transducer).

Another object of the present invention is to provide a mixed transducer which has both the qualities which may be required in respect of a microphone (good sensitivity, sufficiently uniform response curve, wide passband, etc), and the qualities which may be required of a loudspeaker (high sound level, low distortion, fairly wide frequency band if required, etc), while being of small size.

SUMMARY OF THE INVENTION

These objects are achieved in that the electro-acoustic transducer according to the invention comprises:

a receptacle having an opening for communication with the ambient medium;

first and second diaphragms which are spaced from each other within the receptacle, the second diaphragm being capable of vibrating under the effect of acoustic waves and being disposed between the first diaphragm and the opening;

means for vibrating the first diaphragm in response to an electrical excitation signal when the transducer is operating in an emitter mode;

coupling means for transmitting the vibrations of the first diaphragm to said second diaphragm; and means for producing an output signal in response to vibrations of the second diaphragm which are produced by acoustic waves which are propagated in the ambient medium when the transducer is operating in a pick-up mode.

The coupling means may comprise an air cushion contained in a closed chamber separating the two diaphragms, the closed chamber also forming a back acoustic chamber for the second diaphragm when the transducer is operating in the emitter mode.

The coupling effect may also be achieved by a rigid mechanical connection between the two diaphragms.

The means for vibrating the first diaphragm may be an electromagnet.

In addition, it is possible for the second diaphragm to be formed by a sheet of electret, in which case the means for producing the output signal comprise a front electrode and a back electrode which are disposed on respective sides of the sheet of electret, one of the electrodes being fixed with respect to the sheet of electret, said means producing a voltage signal representative of the vibratory movements of the sheet of electret.

BRIEF DESCRIPTION OF THE DRAWINGS

The invention will be better understood by reference to the following description of two possible embodiments of the mixed transducer which is the subject of the invention, with reference to the accompanying drawings in which.

DETAILED DESCRIPTION OF PREFERRED EMBODIMENTS

Figure 1:
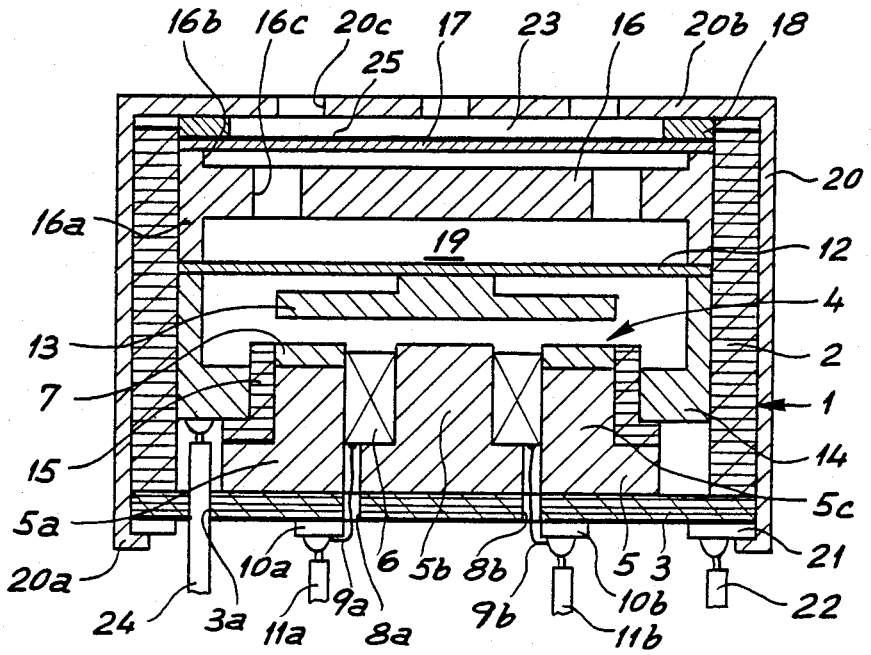
FIG. 1 is a diagrammatic cross-sectional view of a first embodiment of the transducer which has a sheet of electret as the second diaphragm, front and back electrodes as means for producing the output signal, and electromagnetic means for exciting the first diaphragm, and wherein the coupling effect between the two diaphragms is produced by an air cushion.

The mixed electro-acoustic transducer which is shown in diagrammatic cross-sectional view in FIG. 1 comprises an opening casing 1 which is formed by a cylindrical side wall 2 and an end portion 3, each being made of insulating material. The end portion 3 of the casing carries the fixed portion of an electromagnet 4. The fixed portion is a yoke 5 of soft magnetic material having a base portion 5*a* upon which is disposed a core portion 5*b* which is surrounded by a coil 6. A cylindrical portion 5*c* of the yoke 5, which is disposed around the coil 6, has its end surface covered by an annular polarization magnet 7. Two holes 8*a* and 8*b* through the base portion 5*a* of the yoke 5 and the end portion 3 of the casing are provided for the passage of the coil wire.

The ends 9a and 9b of the wire are soldered to respective metal plates 10a and 10b which are carried by the outside surface of the portion 3 of the casing; the end portion 3 of the casing may, advantageously be formed by a printed circuit plate from which the metallized layer has been partially removed. Also soldered to the metal plates 10a and 10b are the ends of two wires 11a and 11b by means of which an electrical excitation signal can be applied to the coil 6.

Disposed in front of the fixed portion of the electromagnet 4 is a first metal diaphragm 12, made for example of steel or beryllium-copper alloy; on its rear face, which faces towards the end portion 3 of the casing, the diaphragm 12 carries a disc 13 of soft magnetic material, forming the movable armature of the electromagnet 4. The metal diaphragm is secured around its periphery, for example by soldering, to a support 14 which is made of an electrically conductive material such as steel or brass and which bears on a flanged insulating bush 15. The insulating bush 15 is in turn supported by the base portion 5a of the yoke 5 so that the armature 13 is disposed at a small distance from the upper face of the core portion 5b of the yoke when the diaphragm 12 is in the rest condition. The function of the insulating bush 15 which separates the support 14 of the diaphragm 12 from the base portion 5a and the cylindrical portion 5c of the yoke 5 will be indicated below.

In this first embodiment, besides the above-described assembly, the general structure of which is that of a loudspeaker of electromagnetic type, the transducer also comprises, still within the casing 1, the components of an electret-type electrostatic microphone. Those components comprise a counter-electrode which is formed by a rigid plate 16 of an electrically conducting material, for example nickel silver. At its periphery, the plate 16 has a rim portion 16a which projects from the side towards the end portion 3 of the casing and which bears against the support 14 in such a way that the plate 16 is spaced from the front face of the metal diaphragm 12, while being electrically connected to the support 14 and also, but not necessarily in this embodiment, to the first diaphragm 12.

The microphone part of the assembly also comprises, as the diaphragm, a sheet of electret 17 which is disposed in front of the counter-electrode 16. The sheet 17 has its front face towards the opening of the casing, being entirely covered by a metal deposit 25 forming a front electrode, and is tightly stretched and fixed to an annular metal ring 18 disposed on the side of the diaphragm bearing the metal deposit, so that there is an electrical connection between the ring 18 and the metal layer 25; that connection may be produced for example by using a conducting adhesive as the fixing means.

As will be seen from FIG. 1, the edge of the back face of the sheet of electret 17 is applied against the periphery of a recess 16b of large area but small depth, formed in the plate 16. The depth of the recess 16b is such as to permit the second diaphragm of the transducer, that is to say the sheet of electret, to vibrate freely, but also such that the distance between the sheet of electret and the counter-electrode 16 is very small. It should be noted that the sheet of electret 17 electrically insulates the metal layer 25 and the ring 18 from the counter-electrode 16.

In addition, the metal plate 16 is apertured with a plurality of holes 16c which can be distributed in a circular arrangement at a sufficient distance from the center of the plate 16 so as not to be virtually closed off by the second diaphragm when this second diaphragm is subjected to vibratory movements which bring the central portion thereof virtually into contact with the electrode 16. The holes 16c provide a communication between the recess 16b and the space between the plate 16 and the first diaphragm 12 so as to form a closed chamber 19 between the two diaphragms, the chamber 19 containing an air cushion by way of which the two diaphragms are coupled together. The chamber 19 also serves as a back acoustic cavity for the second diaphragm 17 when the transducer is operating in the receiver mode.

The transducer shown in FIG. 1 also comprises a metal cover member which is made for example of aluminium and which covers the top of the casing and the side wall 2 thereof, bearing directly against the metal ring 18. The cover member 20 has a plurality of lugs 20a which are bent over the end portion 3 of the casing, thereby to hold the cover member in position. At least one of the lugs 20a is in contact with a third conducting track 21 which is carried by the end portion 3 of the casing and to which an ground wire 22 is soldered. It will be apparent that when the transducer is mounted in a piece of equipment, the wire 22 and the conduction track 21 are superfluous when the cover member 20 is in contact with a member forming part of the equipment ground.

Moreover, the end part 20b of the cover member 20 which covers the opening of the casing 1 is apertured with holes 20c, for example five such holes, which are distributed as shown in the drawing, that is to say, with one hole at the center and four holes disposed in a circle around the central opening, the holes forming a communication between the ambient medium and the chamber 23 disposed between the end part 20b of the cover member and the second diaphragm 17.

Finally, the end portion 3 of the casing is apertured with a hole 3a through which passes a microphone signal output wire 24, the end of which is soldered to the support 14 for the first diaphragm. The wire 24, like the wires 11a, 11b for feeding power to the coil 6 and the ground wire 22, is connected to an electronic circuit (not shown) associated with the transducer.

When the above-described electro-acoustic transducer is operating in the pick-up mode, only the microphone portion thereof operates, in the manner of a conventional electret-type microphone, that is to say, when the acoustic waves to be picked up pass into the chamber 23 by way of the orifices 20c in the cover member 20, the second diaphragm 17 is subjected to vibration. The effect of such vibration is to vary the potential difference between the front electrode 25 and the back electrode 16 which form a variable capacitor permanently charged by the electrical field generated by the sheet of electret in the vicinity thereof. The weak voltage signal which is thus produced is applied to the gate of a field effect transistor forming part of the electronic circuit associated with the transducer, to which the output wire 24 of the microphone is connected, so as to be amplified for subsequent use for given purposes. The fact that an insulating bush 15 is provided between the support 14 for the first diaphragm, which electrically connects the back electrode 16 to the output wire 24, and the yoke 5 of the electromagnet, rather than the support 14 being supported directly on the yoke, makes it possible to substantially reduce the parasitic capacitances to which the output signal of the microphone is highly sensitive.

When the transducer is used as an emitter, an excitation current corresponding to the acoustic signal to be emitted is passed by way of the wires 11*a* and 11*b* into the coil 6 of the electromagnet. An attracting or repelling force which follows the variations in the excitation current acts on the armature 13 and thus causes the first diaphragm 12 to vibrate. The movements of the first diaphragm are transmitted by way of the air cushion contained in the closed chamber 19 to the second diaphragm 17 which then emits an acoustic wave which escapes through the holes 20*c* in the cover member 20.

It will be appreciated that means are provided in the electronic circuit for preventing the presence of an output signal on the wire 24 or for blocking such a signal in the above-described mode of operation. As the second diaphragm must necessarily be thin and flexible and therefore of low equivalent mass in order to have maximum sensitivity to the external acoustic waves when the transducer is used as a microphone, the response curve of the assembly formed by the two diaphragms which are coupled by the air cushion is very close to that which would be obtained if the first diaphragm itself emitted an acoustic wave in response to the excitation signal, both as regards the band width and the value of the sound pressure produced. The mixed transducer is therefore virtually equivalent to a separate microphone and loudspeaker, while enjoying the advantages of being smaller in size and being lower in cost, bearing in mind that only a single casing and a single cover member are required.

It will obviously be appreciated that the nature and the dimensions of the diaphragms 12 and 17, the volume of the chamber 19 which directly influences the sensitivity and the resonant frequency of the transducer, the number, size and distribution of the holes 16*c* in the plate 16 and possibly other parameters such as the volume of the chamber 23, the number, size and arrangement of the orifices 20*c* in the cover member, which may have an effect as regards the characteristics of the transducer, must be selected in dependence on the acoustic signals that the transducer will be required to pick up or emit and the qualities which will be required therefrom, taking into account the use which will be made of the transducer.

Figure 2:
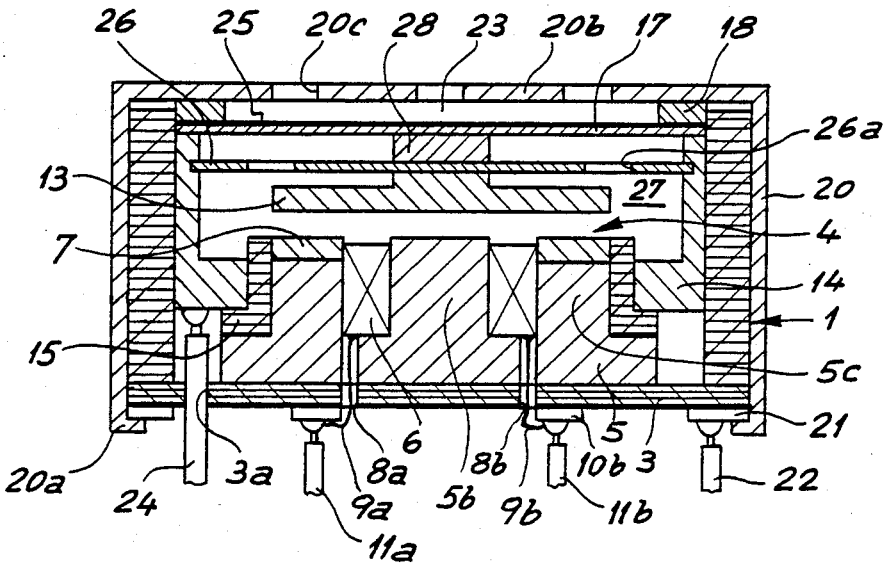
FIG. 2 is a diagrammatic cross-sectional view of a second embodiment which still has the same components, some being designed and arranged differently, and wherein the coupling between the two diaphragms is achieved by a rigid mechanical connection.

FIG. 2 is a diagrammatic cross-sectional view of another possible embodiment of a mixed transducer which still uses the essential components of a loudspeaker of electromagnetic type and an electret microphone. Certain component portions of the transducer shown in FIG. 1, which also appear in the second embodiment in identical form or with minor adapting alterations, are denoted by the same references. In this embodiment, the counter-electrode of the microphone is formed by the first metal diaphragm 26 which in this case must necessarily be electrically connected to its support 14. The first diaphragm which still carries the armature 13 of the electromagnet 4 on its lower face has holes 26*a* for forming a communication between the intermediate space between the two diaphragms 17 and 26, which is very small in this embodiment, and the closed space defined by the upper face of the fixed portion of the electromagnet 4, the support 14 for the first diaphragm 26 and the first diaphragm 26 itself, so as to form a back acoustic cavity 27 of sufficient volume for the second diaphragm 17.

In addition, coupling means are provided to give a rigid mechanical connection between the two diaphragms. The coupling means comprise a metal spacer member 28 which is fixed on the one hand to the front face of the first diaphragm 26, at the center thereof, and on the other hand, to the rear face of the electret sheet 17. Fixing may be effected for example by adhesive bonding or by soldering; in the latter case, it will obviously be necessary to provide a metallization portion at the center of the rear face of the second diaphragm 17. The two diaphragms then only form a single member which vibrates at the frequency of the excitation signal when the transducer operates as an emitter.

This construction has in particular the following advantages, in comparison with that shown in FIG. 1: the transducer is smaller and the sound level is slightly improved, damping of the vibrations of the second diaphragm by the air cushion contained in the chamber 19 (see FIG. 1) being avoided in this embodiment.

It should be noted that the fact that the two diaphragms are rigidly connected together in this way does not detrimentally affect operation of the transducer in the microphone mode. To the contrary, it makes it possible to achieve a better frequency response, at high frequencies.

It will be appreciated that the invention is not limited to the above-described embodiments. For example, the electromagnet may be replaced by a piezoelectric crystal which is fixed onto or coupled to the first diaphragm. Likewise, although the use of the components of an electret-type microphone is advantageous, it is not absolutely essential; such components may be replaced for example by the conducting diaphragm and the counter-electrode of a capacitor-type microphone, although that suffers from the disadvantage of requiring the application of a d.c. voltage between the two, when the transducer is operating in the pick-up mode.

Therefore, without departing from the scope of the invention, it is possible for the mixed transducer to be designed by associating together the components of simple transducers of different types. A number of combinations are possible. Choosing one or other of such combinations obviously depends on the use for which the transucer is intended.

Moreover, it will be appreciated that, when the transducer is used on a piece of equipment, a conducting perforated wall portion thereof may take the place of the cover member. In an electronic watch for example the transducer will be mounted in such a way that the metal ring 18 bears against the casing of the watch which will be provided with holes at that point.

In addition, the casing may be replaced by any other receptacle which is arranged to receive the other components of the transducer. For example, the receptacle may comprise a cavity within an insulating member which is intended to support or contain not only the transducer but also other devices.

What is claimed is:

1. An electro-acoustic transducer which is capable of operating as an emitter and as a pick-up for acoustic waves in an ambient medium, comprising:

a receptacle having an opening for communication with said ambient medium;

first and second diaphragms which are spaced from each other within said receptacle, said second diaphragm being capable of vibrating under the effect of acoustic waves and being disposed between said first diaphragm and said opening;

first means for vibrating said first diaphragm in response to an electrical excitation signal when the transducer is operating in an emitter mode;

coupling means for transmitting the vibrations of said first diaphragm to said second diaphragm; and second means, connected to the second diaphragm, for producing an output signal in direct response to vibrations of said second diaphragm which are produced by acoustic waves which are propagated in said ambient medium when the transducer is operating in a pick-up mode.

2. An electro-acoustic transducer according to claim 1 wherein said coupling means comprise an air cushion contained in a closed chamber separating said first and second diaphragms, said closed chamber also forming a back acoustic cavity for said second diaphragm when the transducer is operating in an emitter mode.

3. An electro-acoustic transducer according to claim 2 wherein said second diaphragm comprises a sheet of electret having a front face towards the opening of the receptacle and wherein said means for producing an output signal comprise a front electrode and a back electrode which are disposed on respective sides of said sheet of electret, one of said electrodes being fixed to said sheet of electret and forming with the other electrode a variable capacitor which is charged by the effect of the electrical field generated by said sheet of electret and produces a voltage signal representative of the vibratory movements of said second diaphragm.

4. An electro-acoustic transducer according to claim 3 wherein said front electrode comprises a layer of electrically conducting material carried by the front face of said sheet of electret.

5. An electro-acoustic transducer according to claim 3 wherein said back electrode comprises a rigid, electrically conducting plate which is disposed within the closed chamber adjacent said sheet of electret, said plate separating said closed chamber into two and being apertured with at least one hole.

6. An electro-acoustic transducer according to claim 1 wherein said coupling means comprises a rigid mechanical connection between said first and second diaphragms.

7. An electro-acoustic transducer according to claim 6 wherein said mechanical connection comprises a spacer member which is fixed to said first and second diaphragms substantially at the centers thereof.

8. An electro-acoustic transducer according to claim 6 wherein said second diaphragm comprises a sheet of electret having a front face towards the opening of the receptacle and a rear face and wherein said means for producing said output signal comprise a front electrode comprising a sheet of electrically conducting material carried by the front face of said sheet of electret and a back electrode which is disposed facing and adjacent to the back face of said sheet of electret, said front and back electrodes forming a variable capacitor which is charged by the effect of the electrical field generated by said sheet of electret and produces a voltage signal which is representative of the vibratory movements of said second diaphragm.

9. An electro-acoustic transducer according to claim 8 wherein said first diaphragm is a metallic diaphragm and forms said back electrode and wherein said first diaphragm which is separated from said sheet of electret by an intermediate space is apertured with orifices communicating said intermediate space with a closed chamber disposed behind said first diaphragm in order to form a back acoustic cavity of sufficient volume for said second diaphragm.

10. An electro-acoustic transducer according to claim 1 wherein said means for vibrating said first diaphragm comprise an electromagnet formed by a fixed portion disposed between said first diaphragm and an end portion of said receptacle and comprising a core portion of soft magnetic material surrounded by a coil to which said electrical excitation signal is applied, and a movable armature which is also of soft magnetic material and fixed to said first diaphragm facing said fixed portion.

11. An electro-acoustic transducer according to claim 1 wherein the second diaphragm has a low equivalent mass as compared to the first diaphragm thereby to maximize sensitivity when the transducer is operating in a pick-up mode.

* * * * *